US006030252A

United States Patent [19]

Oda et al.

[11] Patent Number: 6,030,252

[45] Date of Patent: Feb. 29, 2000

[54] WATERPROOF CONNECTOR AND WATERPROOFING-HOUSING MEMBER USED IN THE SAME

[75] Inventors: Kenzo Oda, Hadano; Yoshihito Fujiwara, Tokyo; Katsumi Shiga, Ichikawa, all of Japan

[73] Assignee: The Whitaker Corporation, Wilmington, Del.

[21] Appl. No.: 09/118,616

[22] Filed: Jul. 17, 1998

[30] Foreign Application Priority Data

Jul. 18, 1997 [JP] Japan ..... 9-209686

[51] Int. Cl.[7] ..... H01R 13/58

[52] U.S. Cl. ..... 439/470; 439/596; 439/936

[58] Field of Search ..... 439/587, 596, 439/274, 275, 279, 523, 936, 470, 467

[56] References Cited

U.S. PATENT DOCUMENTS

| | | | |
|---|---|---|---|
| 4,909,756 | 3/1990 | Jervis | 439/521 |
| 4,998,894 | 3/1991 | Gronvall | 439/521 |
| 5,190,475 | 3/1993 | Dickens | 439/588 |
| 5,759,065 | 6/1998 | Hatagashi et al. | 439/596 |
| 5,897,392 | 4/1999 | Tkahashi | 439/470 |

FOREIGN PATENT DOCUMENTS

| | | | |
|---|---|---|---|
| 0 549 269 | 6/1993 | European Pat. Off. | H01R 13/52 |
| 2 660 118 | 9/1991 | France | H01R 13/514 |
| WO 96 29760 | 1/1996 | WIPO | H01R 4/70 |

OTHER PUBLICATIONS

Patent Abstract of Japan, JP–A–5266941, Applicant, AMP–J, Laid–Open Date, Oct. 15, 1993.

Patent Abstract of Japan, JP–A–9106854, Applicant, Yazaki, Laid–Open date, Apr. 22, 1997.

Patent Abstract of Japan, JP–A–982403, Applicant, Yazaki, Laid–Open date, Mar. 28, 1997.

Patent Abstract of Japan, JP–A–9106853, Applicant Yazaki, Laid–Open date, Apr. 22, 1997.

International Search Report, Applicants's file reference, 51145PCT, International Application No. PCT/US 98/14604, International Filing Date, Jul. 17, 1998.

*Primary Examiner*—Steven L. Stephan
*Assistant Examiner*—J. F. Duverne

[57] ABSTRACT

A waterproof connector which makes it possible to extend wires from a housing at a narrow pitch while waterproofing the wires, and which makes it possible to obtain a highly-reliable waterproofing effect, and a waterproofing-housing member which is used in the waterproof connector. The waterproof connector (10) has a housing (20) and a waterproofing-housing member (30). The waterproofing-housing member (30) includes an inner member (33) and outer members (31, 32) which are formed as integral members of the inner member (33) via hinge members (41, 42). The inner member (33) and outer members (31, 32) are formed so that the members are capable of engaging with each other. When the waterproofing-housing member (30) is engaged on a rear side of the housing (20), the waterproofing-housing member (30) is fastened to the housing (20) while a space between the waterproofing-housing member (30) and the housing (20) is waterproofed; at the same time, the wires (100) are waterproofed and extend rearward.

7 Claims, 4 Drawing Sheets

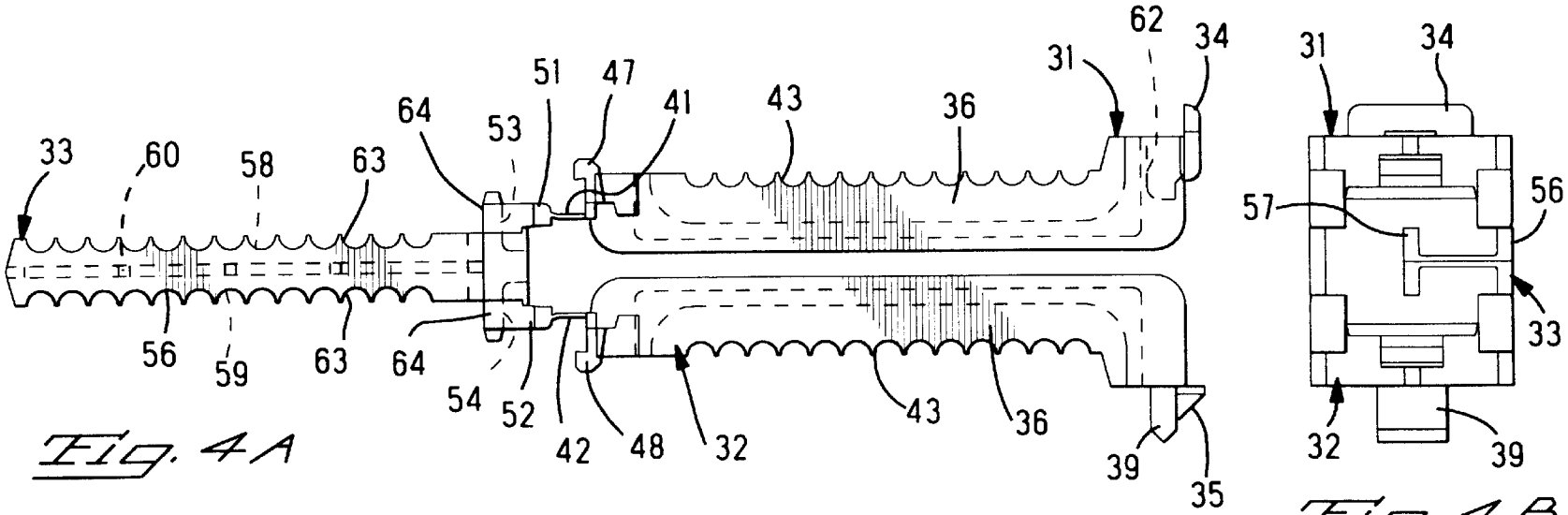
FIG. 4B
FIG. 4A
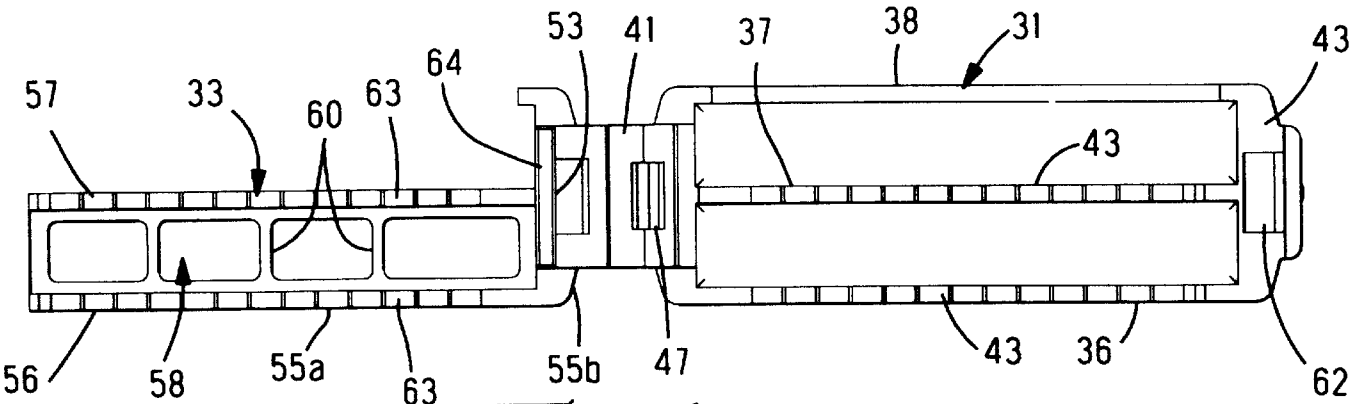
FIG. 4C

WATERPROOF CONNECTOR AND WATERPROOFING-HOUSING MEMBER USED IN THE SAME

FIELD OF THE INVENTION

The present invention relates to a waterproof connector which makes it possible to waterproof and cause to extend from a housing of the connector a plurality of wires disposed at a narrow pitch, and a waterproofing-housing member used in the connector.

BACKGROUND OF THE INVENTION

An example of a waterproof connector with a construction in which a plurality of electrical wires connected to electrical contacts are waterproofed and caused to extend from a housing is disclosed in Japanese Patent Application No. 5-266941. The connector disclosed therein uses an elastic rubber member as a waterproofing member. Wire-accommodating openings, which are used to waterproof and accommodate the electrical wires, are formed in the waterproofing member. However, in cases where an elastic rubber member is used as a waterproofing member, the pitch of the wire-accommodating openings formed is restricted, so that the electrical wires cannot be disposed at a narrow pitch. That is to say, if the wire-accommodating openings are formed at a narrow pitch, the thickness of the elastic rubber member between adjacent openings is reduced, so that there is a danger of splitting in these areas.

Another example of a waterproof connector, which makes it possible to waterproof electrical wires disposed at a narrow pitch is disclosed in Japanese Patent Application No. 9-106854. The waterproof connector disclosed therein includes a waterproofing resin material, which is packed into a cavity formed in a rear portion of a housing. The resin material is packed so that it fills the spaces between the electrical wires and the housing. In the case of this connector, however, gaps are formed between the electrical wires and the resin material when an external force is applied to the wires, so that there is a danger of a deterioration in the waterproof characteristics of the resin material.

Accordingly, an object of the present invention is to provide a waterproof connector, which makes it possible to extend electrical wires from a housing at a narrow pitch while waterproofing the wires, and which makes it possible to obtain a highly-reliable waterproofing effect, and a waterproofing-housing member which is used in the waterproof connector.

SUMMARY OF THE INVENTION

The present invention provides a waterproof connector wherein the connector has a housing which supports a plurality of electrical contacts and from which a plurality of electrical wires connected to the plurality of contacts extend, and a waterproofing-housing member which is formed separately from the housing, the waterproofing-housing member includes at least two members which accommodate a waterproofing gel, which are connected via hinge members, which can pivot relative to each other, and which are capable of engaging with each other, and the waterproofing-housing member is constructed so that when the two or more members are engaged with each other, the plurality of wires are clamped and waterproofed by the accommodated gel, and the members are simultaneously waterproofed and fastened to the housing by the gel.

An annular protruding section, which includes a wire passage through which the plurality of wires can be passed, is formed on the housing. Grooves, which are delineated by ribs, are formed in the outer surface of the protruding section. The grooves are formed so that they are capable of engaging with a flange formed on the waterproofing-housing member.

The plurality of wires are supported in the waterproofing-housing member in a plurality of rows.

The present invention also provides a waterproofing-housing member used in a waterproof connector wherein the waterproofing-housing member comprises at least two members which accommodate a waterproofing gel, which are connected via hinge members, which can pivot relative to each other, and which are capable of engaging with each other, and when the two or more members are engaged with each other, wire-waterproofing compartments are formed in which the electrical wires are clamped and waterproofed by the gel, and a housing-waterproofing compartment in which a space between the waterproofing-housing member and the housing including engaging means which engage with the housing is waterproofed by the gel. The members include an inner member and a pair of outer members which are integrally connected to the inside member via hinge members.

The inner member has a first wall and a second wall in the direction of width, and the outer members have first through third walls in the direction of width. The respective first walls and second walls of the inner member and outer member act in conjunction with each other to delineate the wire waterproofing compartments, and the second and third walls of the outer members act in conjunction with each other to delineate the housing waterproofing compartments. The third walls form a flange, which engages with the housing.

A waterproof connector comprises a housing for supporting a plurality of electrical contacts from which extend electrical wires terminated to the electrical contacts, a waterproofing gel disposed in a rear portion of the housing for engagement with the electrical wires, wherein a waterproofing-housing member is mounted on the housing and includes at least two members connected together via hinge members enabling the two members to pivot relative to each other and to engage with each other thereby engaging portions of the electrical wires adjacent the housing, gel-accommodating recesses provided by the two members in which a waterproofing gel is disposed, and latch members on the two members for latching the two members together so that the waterproofing gel engages the portions of the electrical wires extending through the waterproofing-housing member.

BRIEF DESCRIPTION OF THE DRAWINGS

An embodiment of the present invention will now be described by way of example with reference to the accompanying drawings in which:

FIGS. 3A and 3B are views from different directions.

FIGS. 4A–4C illustrate the waterproofing-housing member shown in FIG. 3; FIG. 4A is a front view, FIG. 4B is a left-side view of FIG. 4A, and FIG. 4C is a top plan view.

FIGS. 5A and 5B are views from different directions.

DETAILED DESCRIPTION OF THE INVENTION

Figure 1:
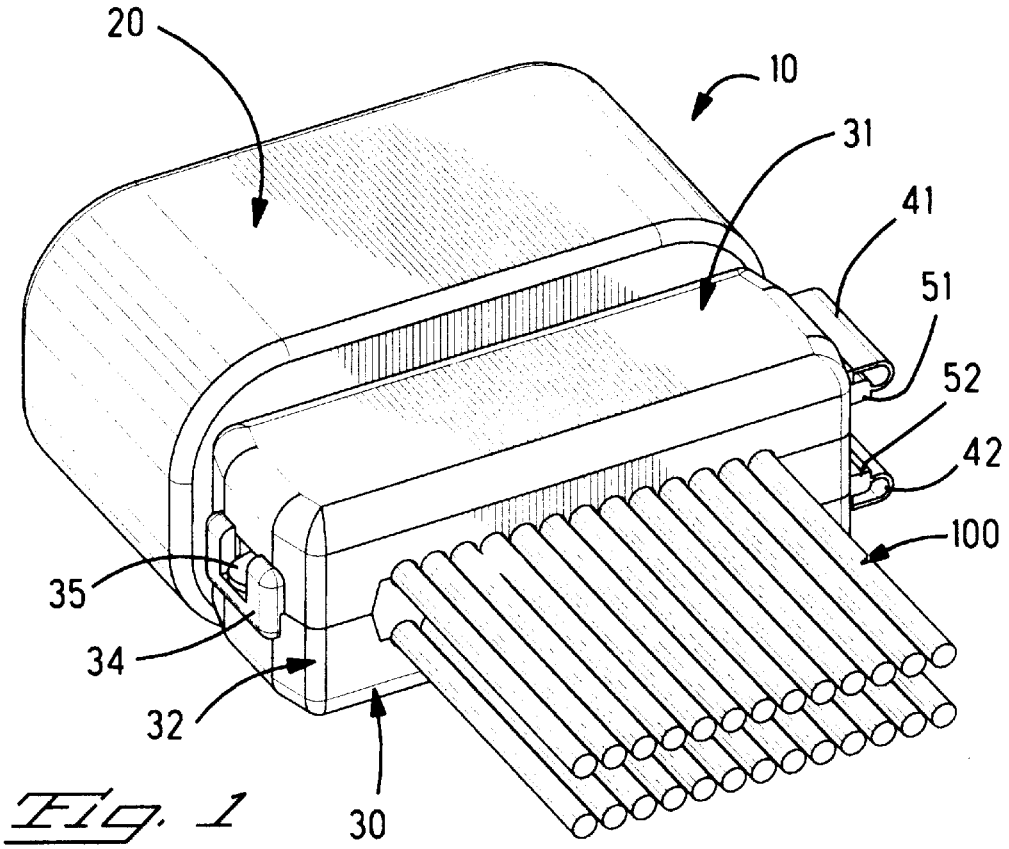
FIG. 1 is a perspective view of a waterproof connector of the present invention.

In FIG. 1, waterproof connector 10 includes a housing 20 and a waterproofing-housing member 30 which is mounted on a rear side of the housing 20. As shown in FIG. 1, the waterproofing-housing member 30 accommodates and waterproofs a plurality of electrical wires 100, which are disposed at a narrow pitch. Although not shown, the ends of the respective wires 100 are terminated by electrical contacts, which are supported in the housing 20. As will be described later, the waterproofing-housing member 30 supports and waterproofs the plurality of wires by allowing the wires to pass therethrough, and it also provides a waterproofing action between itself and the housing 20. The construction for the waterproofing will be described later.

Figure 2:
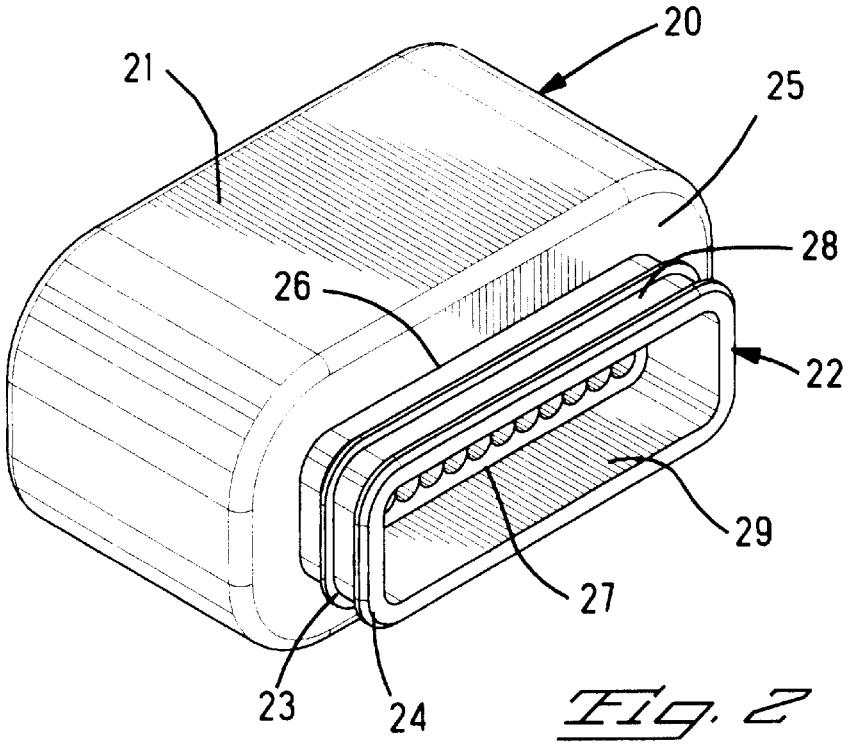
FIG. 2 is a perspective view of a housing of the waterproof connector shown in FIG. 1.

The housing 20, as shown in FIG. 2, has an annular protruding section 22 on the rear side of a housing main body 21. The protruding section 22 engages with the waterproofing-housing member 30, and it has an inner groove 26 and an outer groove 28, which are delineated by ribs 23 and 24. The engagement relationship between the housing 20 and the waterproofing-housing member 30 will be made clear by a later description. A wire passage 29, which accommodates the plurality of electrical wires 100 and a plurality of wire-accommodating cavities 27 which are capable of accommodating the respective wires 100, are formed inside the protruding section 22. The wire accommodating cavities 27 are formed with dimensions which allow the contacts terminating the wires 100 to be introduced into the housing main body 21.

The waterproofing-housing member 30, as shown in FIGS. 3A–5B, comprises three parts, i.e., first and second outer members 31 and 32, and an inner member 33, which are connected to each other by two hinge members 41, 42. A U-shaped latch 34, which constitutes an engaging member, and a projection 35, which is capable of engaging with latch 34, are respectively disposed on the outside ends of the first and second outer members 31, 32. As shown, the projection 35 protrudes outward from a post 39 which protrudes from the outside end of the second outer member 32. The first and second outer members 31, 32 are formed in a mirror-symmetrical relationship except for the engaging parts, i.e., the latch 34, post 39 and projection 35. Furthermore, hook members 47, 48, which face outward, are disposed on the inside ends of the first and second outer members 31, 32. The operation of the hook members 47, 48 will be described later.

As shown, the outer member 32 has a first outer wall 36, a second intermediate wall 37, and a third outer wall 38. A plurality of substantially semicircular recesses 43, which are capable of accommodating the respective electrical wires 100, are formed in the first wall 36 and second wall 37, and a substantially U-shaped recess 44 is formed in the third wall 38 across substantially the width thereof. First and second gel-accommodating recesses 45, 46 are delineated by the walls 36, 37, 38. Although not shown, the outer member 31 has a corresponding structure and need not be described.

As was described above, the inner member 33 is joined to the first and second outer members 31, 32 via the hinge members 41, 42. The hinge members 41, 42 extend from extensions 51, 52, which protrude to the side from the upper and lower portions of an inner end 64 of the inner member 33. As will be described later, apertures 53, 54, which engage with the hook members 47, 48, are formed in the extensions 51, 52. As shown in FIG. 4C, main body portion **55*a* of the inner member 33 is formed with a narrower width than the end portion 55*b*, and is formed with dimensions corresponding to the first gel-accommodating recess 45. The main body portion 55*a* is formed with a frame shape, and it includes a first wall 56 and a second wall 57, which extend parallel to each other in the direction of width from inner end 64 and are interconnected by spaced ribs 60. The first wall 56 and second wall 57 delineate gel-accommodating areas 58, 59 on an upper side and bottom side of inner member 33. Substantially semicircular recesses 63, which are capable of accommodating the electrical wires 100 in conjunction with recesses 43 formed in the first walls 36 and second walls 37 of the outer members 31 and 32, are formed in the top and bottom edges of the first wall 56 and second wall 57**.

Figure 3A:
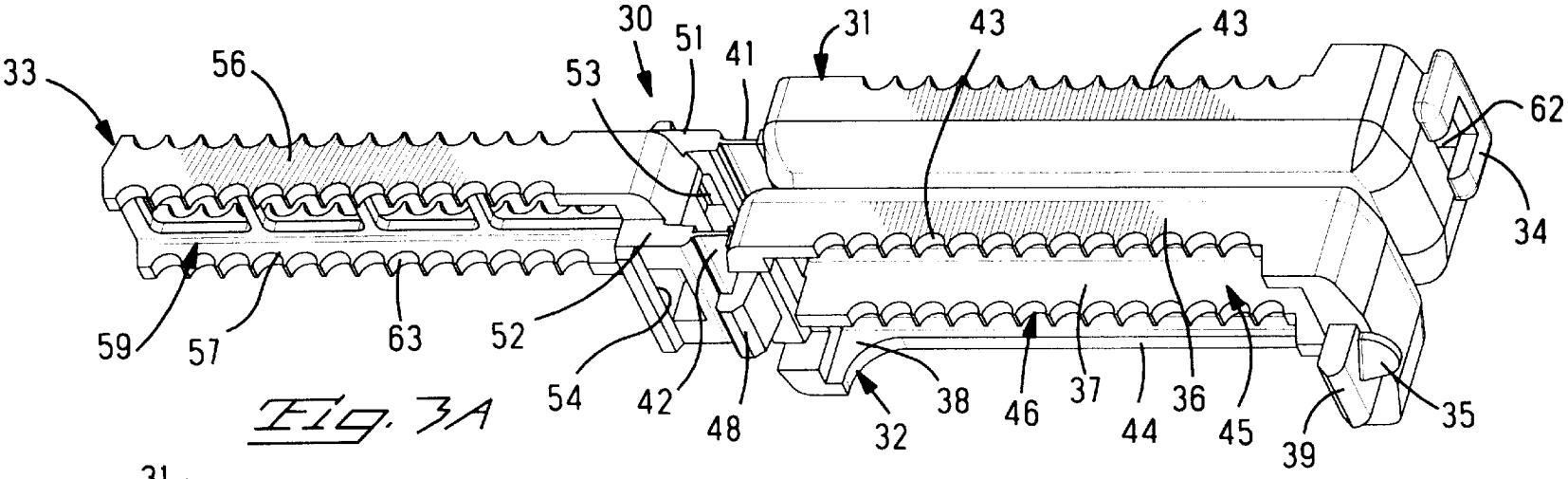
FIGS. 3A and 3B show perspective views which illustrate the state of a waterproofing-housing member prior to assembly.
Figure 3B:
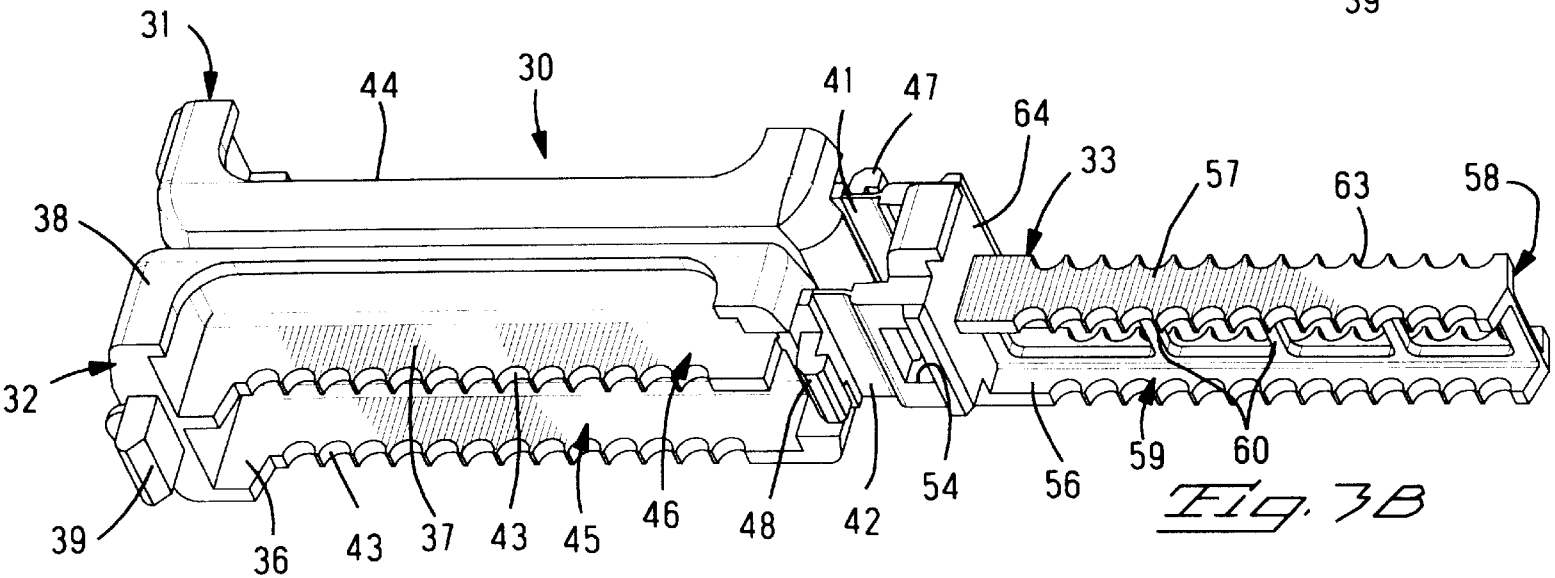

Furthermore, it should be noted that the state shown in FIGS. 3 and 4 is the state immediately following the completion of molding. Since the outer members 31, 32 and the inner member 33, which are joined to each other by a method which will be described below, are integrally formed as shown in FIGS. 3 and 4, the waterproofing-housing member 30 can be made relatively inexpensively. Furthermore, since there is no danger that parts will be lost in the assembly process, the assembly work can be performed quickly and reliably.

Below, the engagement and assembly of the waterproofing-housing member 30 will be described in order with reference to FIG. 1 and FIGS. 3 through 5.

First, in the state shown in FIG. 3, a waterproofing gel is deposited in the first and second gel-accommodating recesses 45, 46 of the outer members 31, 32, and in the gel-accommodating areas 58, 59 of the inner member 33. The amount of gel that is deposited is slightly greater than the volume of the first and second gel-accommodating recesses 45, 46 so that the gel is subjected to a slight compressive force. The gel is held in a prescribed position by the compressive force or by an adhesive force of the gel material.

Next, the electrical wires 100 terminated to the electrical contacts are accommodated in the recesses 63 of the first wall 56 and second wall 57 of the inner member 33 of the waterproofing-housing member 30, and the contacts are secured in prescribed positions inside the housing main body 21. Furthermore, the inner member 33 of the waterproofing-housing member 30 is positioned adjacent to the rear side of the housing main body 21, and the outer members 31, 32 are pivoted 180 degrees relative to the inner member 33 via the hinge members 41, 42. The outer members 31, 32 are pivoted to positions in which the outer members 31, 32 are superimposed on both sides of the inner member 33 as shown in FIG. 5. In this case, the hook members 47, 48 pass through the apertures 53, 54 and engage with the edges of the apertures 53, 54 in the extensions 51, 52. Moreover, the latch 34 of the outside member 31 engages with the projection 35 of the outside member 32. As a result, the outer members 31, 32 and inner member 33 are latched together. The post 39 on which the projection 35 is located is accommodated in the recess 62 (see FIGS. 4A and 4C) formed to the inside of the latch 34 of the outside member 31. Furthermore, the wall portion 64 of the inside end portion **55*b* of the inner member 33 is positioned on the inside of the hook members 47, 48**, thus forming enveloping walls to envelop and seal in the gel, as will be described later.

Figure 5A:
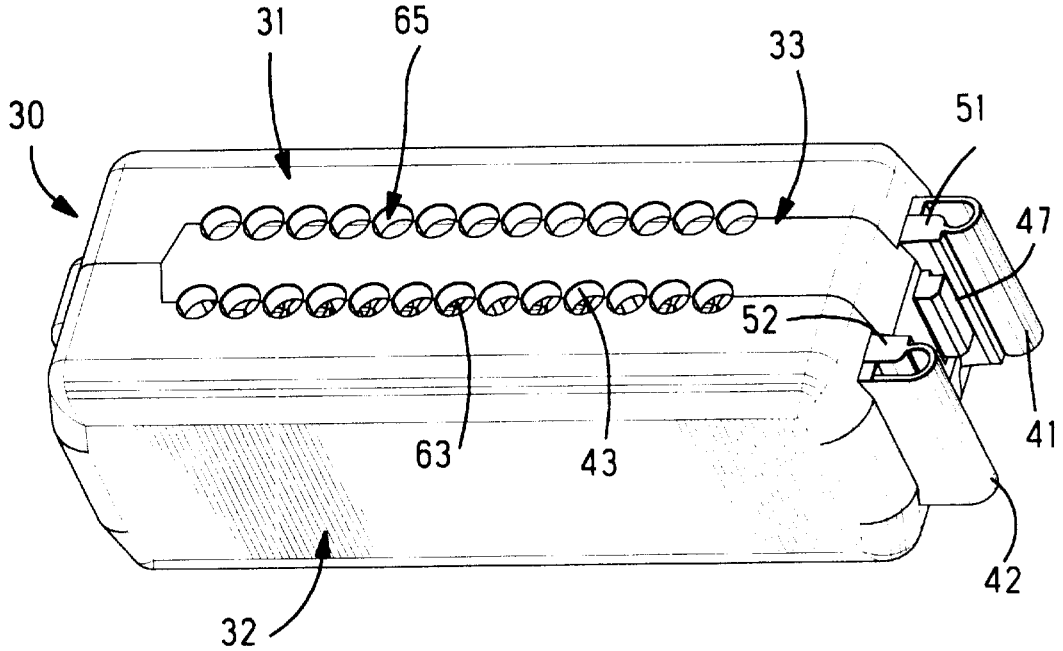
FIGS. 5A and 5B show perspective views which illustrate the engaged and assembled state of the waterproofing-housing member.
Figure 5B:
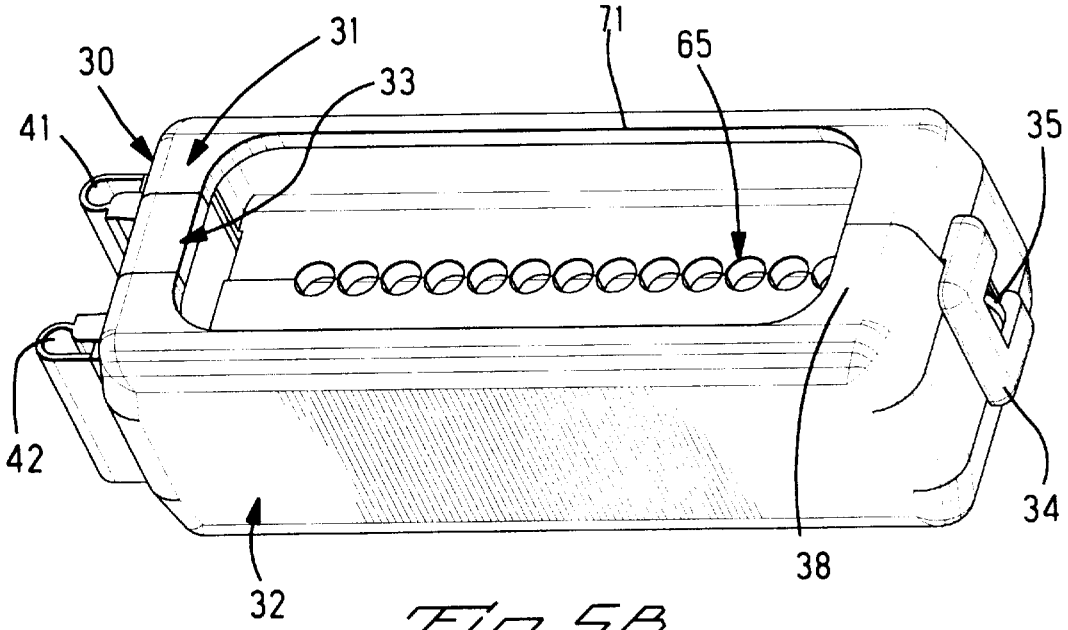

As shown in FIGS. 5A and 5B, accommodating holes 65, each of which is capable of accommodating one of the wires 100, are formed by combinations of the recesses 43 and recesses 63 as a result of the engagement of the outer members 31, 32 and inner member 33. As a result of the assembly of the outer members 31, 32 and inner members 33, the first gel-accommodating recesses 45 and the gel-accommodating areas 58, 59 form wire-waterproofing compartments that waterproof the wires 100 (although this is not shown in FIG. 5). The wires 100 are clamped by the gel sealed inside the wire-waterproofing compartments, so that optimum waterproof characteristics are obtained in the direction of length of the wires 100.

Furthermore, as shown in FIG. 5B, when the outer members 31, 32 and inner member 33 are assembled, the third walls 38 of the outer members 31, 32 and the wall 57 of the inside member 33 form a flange 71. When the waterproofing-housing member 30 is assembled in a position adjacent to the housing 20, the flange 71 engages with the inside groove 26 formed in the protruding section 22. In this case, a housing-waterproofing compartment is formed by the flange 71 and the wall 57. The gel positioned in the second gel-accommodating recesses 46 of the housing-waterproofing compartment is superimposed on the ribs 23, 24 of the protruding section 22 and the outside groove 28 delineated by the ribs 23, 24, so that the gel is substantially compressed in the space formed with the protruding section 22. As a result, optimum waterproof characteristics are obtained between the housing 20 and the waterproofing-housing member 30. Furthermore, a gap of small dimensions is formed between the flange 71 and the rear surface 25 of the housing main body 31 in order to allow a slight deflection of the waterproofing-housing member 30 caused by the deformation of the gel.

The waterproof connector 10 shown in FIG. 1 is completed as a result of the assembly described above. The waterproof connector 10 can position and waterproof a plurality of wires 100 at a narrow pitch in two rows.

In the waterproof connector of the present invention, the connector has a housing which supports a plurality of electrical contacts, and from which a plurality of electrical wires connected to the plurality of contacts extend, and a waterproofing-housing member which is formed separately from the housing, the waterproofing-housing member comprises at least two members which accommodate a waterproofing gel, which are connected via hinge members, which can pivot relative to each other, and which are capable of engaging with each other, and the waterproofing-housing member is constructed so that when the two or more members are engaged with each other, the plurality of wires are clamped and waterproofed by the accommodated gel, and the members are simultaneously waterproofed and fastened to the housing by the gel. Accordingly, a plurality of wires can extend from the housing while being waterproofed; furthermore, a highly-reliable waterproofing effect can be obtained. Moreover, in the waterproof connector of the present invention, the engagement and assembly of the housing main body and waterproofing-housing member can easily be accomplished.

The waterproofing-housing member of the present invention includes at least two members which accommodate a waterproofing gel, which are connected via hinge members, which can pivot relative to each other, and which are capable of engaging with each other, and when the two members are engaged with each other, wire-waterproofing compartments in which the wires are clamped and waterproofed by the gel, and a housing-waterproofing compartment in which the space between the waterproofing-housing member and the housing is waterproofed by the gel, are formed. Accordingly, optimum waterproof characteristics can be realized by means of a relatively simple construction. In particular, the waterproofing-housing member is formed as an integral unit in which the respective members that are engaged are connected via hinge members; accordingly, the waterproofing-housing member can be obtained relatively inexpensively.

We claim:

1. A waterproof connector, comprising a housing for supporting a plurality of electrical contacts from which extend electrical wires terminated to the electrical contacts;

a waterproofing-housing member mounted on the housing and including at least two members connected together via hinge members enabling the two members to pivot relative to each other and to engage with each other thereby engaging portions of the electrical wires adjacent the housing;

gel-accommodating-recesses provided by the two members in which a waterproofing gel is disposed; and latch members on the two members for latching the two members together so that the waterproofing gel engages the portions of the electrical wires extending through the waterproofing-housing member, wherein each of the two members includes a first outer wall, a second intermediate wall and a third outer wall, the intermediate wall being disposed between the first outer wall and the third outer wall.

2. A waterproof connector as claimed in claim 1, wherein the two members define outer members and are hingedly connected to an inner member via the hinge members.

3. A waterproof connector as claimed in claim 1, wherein the inner member includes parallel walls extending from an inner end thereof.

4. A waterproof connector as claimed in claim 3, wherein the first wall, the intermediate wall of the outer members and the parallel walls of the inner member include semicircular recesses to accommodate the electrical wires.

5. A waterproof connector as claimed in claim 4 wherein inner ends of the outer members have hook members, and an inner end of the inner member includes extensions having apertures therein for receiving the hook members.

6. A waterproof connector as claimed in claim 3, wherein the third outer walls of the outer members include a recess extending substantially along the length thereof so that when the outer members and the inner member are assembled a flange is formed by the recesses in the third outer walls of the outer members and one of the parallel walls of the inner member.

7. A waterproof connector as claimed in claim 6, wherein the housing has a protruding section including a groove in which the flange is disposed.

* * * * *